US009744587B2

(12) United States Patent
Fargeas et al.

(10) Patent No.: US 9,744,587 B2
(45) Date of Patent: Aug. 29, 2017

(54) MOULD FOR MONOCRYSTALLINE CASTING

(71) Applicant: SAFRAN AIRCRAFT ENGINES, Paris (FR)

(72) Inventors: Serge Fargeas, Moissy-Cramayel (FR); Dominique Coyez, Moissy-Cramayel (FR)

(73) Assignee: Safran Aircraft Engines, Paris (FR)

( * ) Notice: Subject to any disclaimer, the term of this patent is extended or adjusted under 35 U.S.C. 154(b) by 0 days.

(21) Appl. No.: 15/305,576

(22) PCT Filed: Apr. 17, 2015

(86) PCT No.: PCT/FR2015/051044
§ 371 (c)(1),
(2) Date: Oct. 20, 2016

(87) PCT Pub. No.: WO2015/162362
PCT Pub. Date: Oct. 29, 2015

(65) Prior Publication Data

US 2017/0043391 A1 Feb. 16, 2017

(30) Foreign Application Priority Data

Apr. 24, 2014 (FR) ..... 14 53693

(51) Int. Cl.
*B22C 9/04* (2006.01)
*B22C 9/22* (2006.01)
(Continued)

(52) U.S. Cl.
CPC ..... *B22C 9/043* (2013.01); *B22C 7/02* (2013.01); *B22C 9/04* (2013.01); *B22C 9/22* (2013.01);
(Continued)

(58) Field of Classification Search
CPC .. B22C 7/02; B22C 9/04; B22C 9/043; B22C 9/22; B22D 25/02; B22D 27/045
(Continued)

(56) References Cited

U.S. PATENT DOCUMENTS 4,940,073 A 7/1990 Jeyarajan et al.
5,404,930 A 4/1995 Stanton et al.
(Continued)

FOREIGN PATENT DOCUMENTS

EP 1 452 251 A1 9/2004
EP 1 894 647 A1 3/2008
(Continued)

OTHER PUBLICATIONS

International Search Report in corresponding International Application No. PCT/FR2015/051044 mailed Oct. 2, 2015 (7 pages—English Translation included).

*Primary Examiner* — Kevin E Yoon
(74) *Attorney, Agent, or Firm* — Bookoff McAndrews, PLLC

(57) ABSTRACT

The invention relates to the field of monocrystalline casting, and more specifically to a mold (1) for monocrystalline casting, and also to fabricating and using the mold. In particular, the mold (1) presents a mold cavity (7) comprising a first volume (7*a*), a second volume (7*b*) and a grain duct (4). The second volume (7*b*) is situated on the first volume (7*a*), being in communication therewith, and includes at least one horizontal projection relative to the first volume (7*a*). The grain duct (4) has a bottom end (4*a*) connected to the first volume (7*a*) and a top end (7*b*) adjacent to said horizontal projection of the second volume (7*b*). The mold (1) also has a separator member (11) interposed between the second volume (7*b*) of the mold cavity (7) and the top end (4*b*) of the grain duct (4).

8 Claims, 5 Drawing Sheets

(51) Int. Cl.

| | |
|---|---|
| ***B22D 25/02*** | (2006.01) |
| ***B22D 27/04*** | (2006.01) |
| ***B22C 7/02*** | (2006.01) |
| ***B22D 18/06*** | (2006.01) |
| ***B22D 29/00*** | (2006.01) |

(52) U.S. Cl.
CPC ..... *B22D 18/06* (2013.01); *B22D 25/02* (2013.01); *B22D 27/045* (2013.01); *B22D 29/00* (2013.01)

(58) Field of Classification Search
USPC ..... 164/23, 24, 34, 35, 122–122.2, 516–529
See application file for complete search history.

(56) References Cited

U.S. PATENT DOCUMENTS

| | | | | |
|---|---|---|---|---|
| 7,762,309 | B2 * | 7/2010 | Tamaddoni-Jahromi | B22D 27/045 164/122.1 |
| 8,201,612 | B2 * | 6/2012 | Fargeas ..... | B22D 27/045 164/122 |
| 2009/0078390 | A1 | 3/2009 | Tamaddoni-Jahromi et al. | |

FOREIGN PATENT DOCUMENTS

| | | | |
|---|---|---|---|
| EP | 2 092 999 | A1 | 8/2009 |
| FR | 2 734 189 | A1 | 11/1996 |
| FR | 2 995 807 | A1 | 3/2014 |

* cited by examiner

MOULD FOR MONOCRYSTALLINE CASTING

CROSS-REFERENCE TO RELATED APPLICATIONS

This application is the U.S. national phase entry under 35 U.S.C. §371 of International Application No. PCT/FR2015/051044, filed on Apr. 17, 2015, which claims priority to French Patent Application No. 1453693, filed on Apr. 24, 2014.

BACKGROUND OF THE INVENTION

The present invention relates to the field of casting, and more particularly to a model for lost-pattern casting, and also to methods of fabricating shell molds and of casting using such a model.

In the description below, the terms "top", "bottom", "horizontal", and "vertical" are defined relative to the normal orientation of such a mold while metal is being cast into it.

So-called "lost-wax" or "lost-pattern" casting methods have been known since antiquity. They are particularly suitable for producing metal parts of complex shape. Thus, lost-pattern casting is used in particular for producing turbomachine blades.

In lost-pattern casting, the first step is normally to make a model out of a material having a melting temperature that is comparatively low, e.g. a wax or a resin. The model is itself coated in a refractory material in order to from a mold, in particular a mold of the shell mold type. After the model of the material has been emptied out or eliminated from the inside of the mold, whence the name for such "lost-pattern" methods, a molten metal is poured into the mold in order to fill the cavity left by the model in the mold after the model has been emptied out or eliminated. Once the metal cools and solidifies, the mold can be opened or destroyed in order to recover a metal part having the shape of the model. In the present context, the term "metal" covers both pure metals and above all metal alloys.

In order to be able to produce a plurality of parts simultaneously, it is possible to unite a plurality of models in a single cluster in which they are connected together by a shaft that forms casting channels in the mold for the molten metal.

Among the various types of mold that can be used in lost-pattern casting, so-called "shell" molds are known that are formed by dipping the model or the cluster of models in a slip, followed by dusting the slip-covered model or cluster with refractory sand in order to form a shell around the model or the cluster, and then baking the shell in order to sinter it so as to consolidate the shell as a whole. It is possible to envisage dipping and dusting several times in succession in order to obtain a shell of sufficient thickness before baking. The term "refractory sand" is used in the present context to designate any granular material of grain size that is sufficiently fine to meet the desired production tolerances, and that is capable in the solid state of withstanding the temperatures of the molten metal, while also being capable of being consolidated to form a single piece while the shell is being baked.

In order to obtain particularly advantageous thermomechanical properties in a part produced by casting, it may be desirable to ensure that the metal is subjected to directional solidification in the mold. In the present context, the term "directional solidification" is used to mean that as the molten metal passes from the liquid state solid crystals are seeded and grown therein under control. The purpose of such directional solidification is to avoid the negative effects of grain boundaries in the part. Thus, directional solidification may take place in columns or it may be monocrystalline. Directional solidification in each column consists in orienting all of the grain boundaries in the same direction so that they cannot contribute to propagating cracks. Monocrystalline directional solidification consists in ensuring that the part solidifies as a single crystal, so as to eliminate all grain boundaries.

In order to obtain such monocrystalline directional solidification, the mold typically presents in the mold cavity a "starter" cavity that is connected to the mold cavity via a selector channel, as disclosed for example in French patent FR 2 734 189. While the metal is solidifying in the mold, the mold is caused to cool progressively, starting from the starter cavity, so as to cause crystals to be seeded therein. The role of the selector channel is firstly to give precedence to a single grain, and secondly to enable that single grain to advance towards the mold cavity from the crystallization front of that grain as seeded in the starter cavity.

An awkward shape in the mold cavity can constitute an obstacle to such directional solidification. Thus, in a mold cavity presenting a large horizontal projection, in particular a projection corresponding to the platform of a turbomachine blade, the solidification front can suddenly cease to advance in a substantially vertical direction and can begin advancing in the direction of the projection. Such a sudden change of direction can give rise to defects, and in particular to unwanted grains, in the proximity of the projection.

In order to avoid that, the person skilled in the art makes use of grain ducts, serving to provide the solidification front with alternative paths to horizontal projections in mold cavities, and to do so without any sudden change of direction. Nevertheless, a drawback of such a grain duct is that it makes the mold more difficult to knock out, and above all the metal branches that result from the solidification of the metal material in the grain duct subsequently need to be removed from the raw casting, thereby adding finishing-off steps that are complicated and expensive.

OBJECT AND SUMMARY OF THE INVENTION

The present disclosure seeks to remedy those drawbacks by proposing a monocrystalline casting mold for molding parts that present large lateral projections, while nevertheless facilitating subsequent treatment of the raw casting.

In at least one embodiment, this object is achieved by the fact that the mold, which presents a mold cavity comprising: a first volume; a second volume situated on the first volume, in communication therewith, and having at least one horizontal projection relative to the first volume; and a grain duct with a bottom end connected to the first volume and a top end adjacent to said horizontal projection of the second volume, further comprises a separator member interposed between said second volume of the mold cavity and the top end of the grain duct.

By means of these provisions, the cooling, and thus the solidification, of the metal material in the mold cavity can advance through the grain duct towards the horizontal projection without the metal material in the horizontal projection coming directly into contact with the material in the grain duct, thus making it easier to separate the metal branch formed by the grain duct from the remainder of the raw casting.

In order to ensure constant advance of the cooling front in the mold cavity, the top end of the grain duct may present a width that is substantially equal to said horizontal projection of the second volume.

In particular, such a mold may be used for producing turbomachine blades, with this applying both to stationary guide vanes and to movable blades. For this purpose, the first volume of the mold cavity may correspond to a turbomachine blade body and the second volume of the mold cavity may correspond to a turbomachine blade platform. In the present context, the term "turbomachine" covers any machine in which energy is transferred between a fluid flow and at least one set of blades, such as for example a compressor, a pump, a turbine, or a combination of at least two of them.

In order to facilitate directional solidification of the molten metal material in the mold cavity, the mold may also present, under the mold cavity, a starter cavity connected to the mold cavity by a selector channel.

The present disclosure also relates to a method of fabricating such a monocrystalline casting mold, the method comprising the steps of: making a model reproducing the shape of the mold cavity; coating said model in a refractory material so as to form the mold cavity; and emptying out the mold cavity.

In particular, in order to make it easier to incorporate the separator member in the mold, said separator member may be inserted in the model before the coating step. In particular, the model may be made of a material that melts at a temperature lower than said refractory material, such as for example a wax or a resin, and it may be emptied out from the mold cavity in the liquid state, using the so-called "lost-wax" method.

In particular, said coating step may be performed by dipping the model in a slip, dusting the model with a refractory sand in order to form a shell around the model, and sintering the shell in order to consolidate it, thereby forming a shell mold.

The present disclosure also provides a method of using such a mold, the method comprising: vacuum casting a metal material in the liquid state into the mold cavity; causing the metal material to solidify in directional manner from the bottom of the mold cavity towards the top; and knocking out the mold, including the separator member interposed between the second volume of the mold cavity and the top end of the grain duct. In the present context, the term "vacuum" should be understood as meaning a pressure significantly lower than atmospheric pressures, and in particular less than 0.1 pascals (Pa) to 0.01 Pa. After the mold has been knocked out, the raw casting formed by the metal material that has solidified inside the mold cavity may be subjected to additional treatments, in particular in order to separate the branch of metal material that has solidified in the grain duct.

BRIEF DESCRIPTION OF THE DRAWINGS

The invention can be well understood and its advantages appear better on reading the following detailed description of an embodiment shown by way of non-limiting example. The description refers to the accompanying drawings, in which.

DETAILED DESCRIPTION OF THE INVENTION

Figure 1:
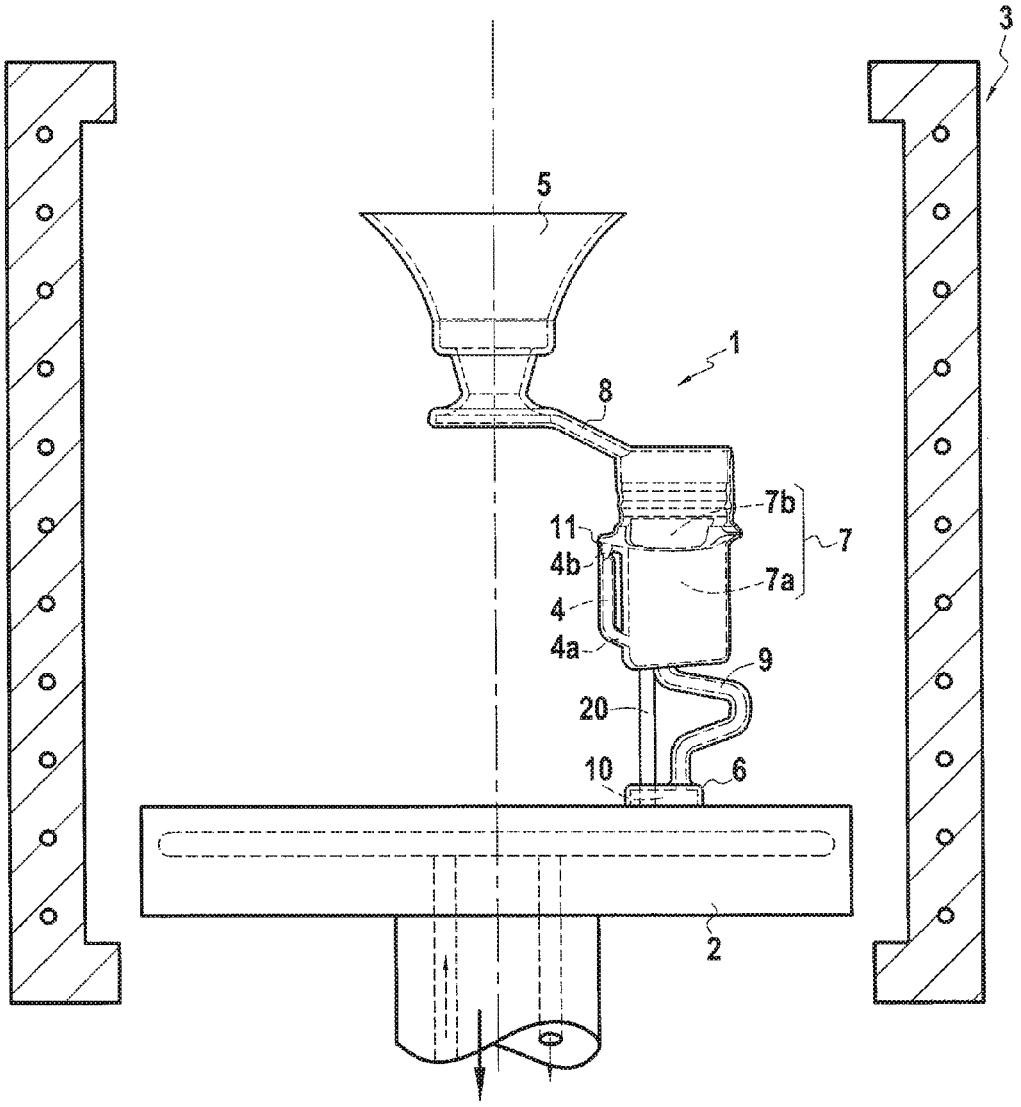
FIG. 1 is a diagrammatic view of a monocrystalline casting installation with a mold constituting an embodiment of the invention.

FIG. 1 shows how progressive cooling of molten metal for obtaining directional solidification can typically be performed in a casting method.

The mold 1 used in this method comprises a pouring bush 5 and a base 6. While the mold 1 is being extracted from the heater chamber 3, the base 6 is directly in contact with a soleplate 2. The mold 1 also has a molding cavity 7. It is also possible to arrange a plurality of molding cavities in a cluster in the same mold. The molding cavity 7 is connected to the pouring bush 5 by a feed channel 8 into which molten metal penetrates while it is being poured. The molding cavity 7 is also generally connected at the bottom via a baffle-shaped selector channel 9 to a smaller starter cavity 10 in the base 6. In the embodiment shown, the molding cavity 7 has a first volume 7*a* and a second volume 7*b* situated directly above the first volume 7*a*, and in communication therewith, while being substantially wider in a horizontal plane, so as to present at least one very significant horizontal projection relative to the first volume 7*a*. More specifically, in the embodiment shown, the mold 1 is for producing turbomachine blades. Consequently, the first volume 7*a* corresponds to a blade body and the second volume 7*b* corresponds to a blade platform.

The molding cavity 7 also has a grain duct 4 with a bottom end 4*a* directly connected to the first volume 7*a* and a top end 4*b* adjacent to the horizontal projection of the second volume 7*b*. In the embodiment shown, said top end 4*b* is wider than the remainder of the grain duct 4 so as to be adjacent to said horizontal projection of the second volume 7*b* over the entire width L of the second volume 7*b*. Although adjacent, the top end 4*b* of the grain duct 4 and said second volume 7*b* are not in direct communication, since they are separated by a rod-shaped separator member 11.

By way of example, the separator member 11 may be made of ceramic material. Although in the embodiment shown it is in the form of a cylindrical rod of circular cross-section, other cross-sections and other general shapes could alternatively be adopted, depending on circumstances. The dimensions and the thermal conductivity of the material of the rod may be selected so as to provide good thermal contact between the top end 4*b* of the grain duct 4 and the adjacent horizontal projection of the second volume 7*b* of the mold cavity 7.

Figure 2:
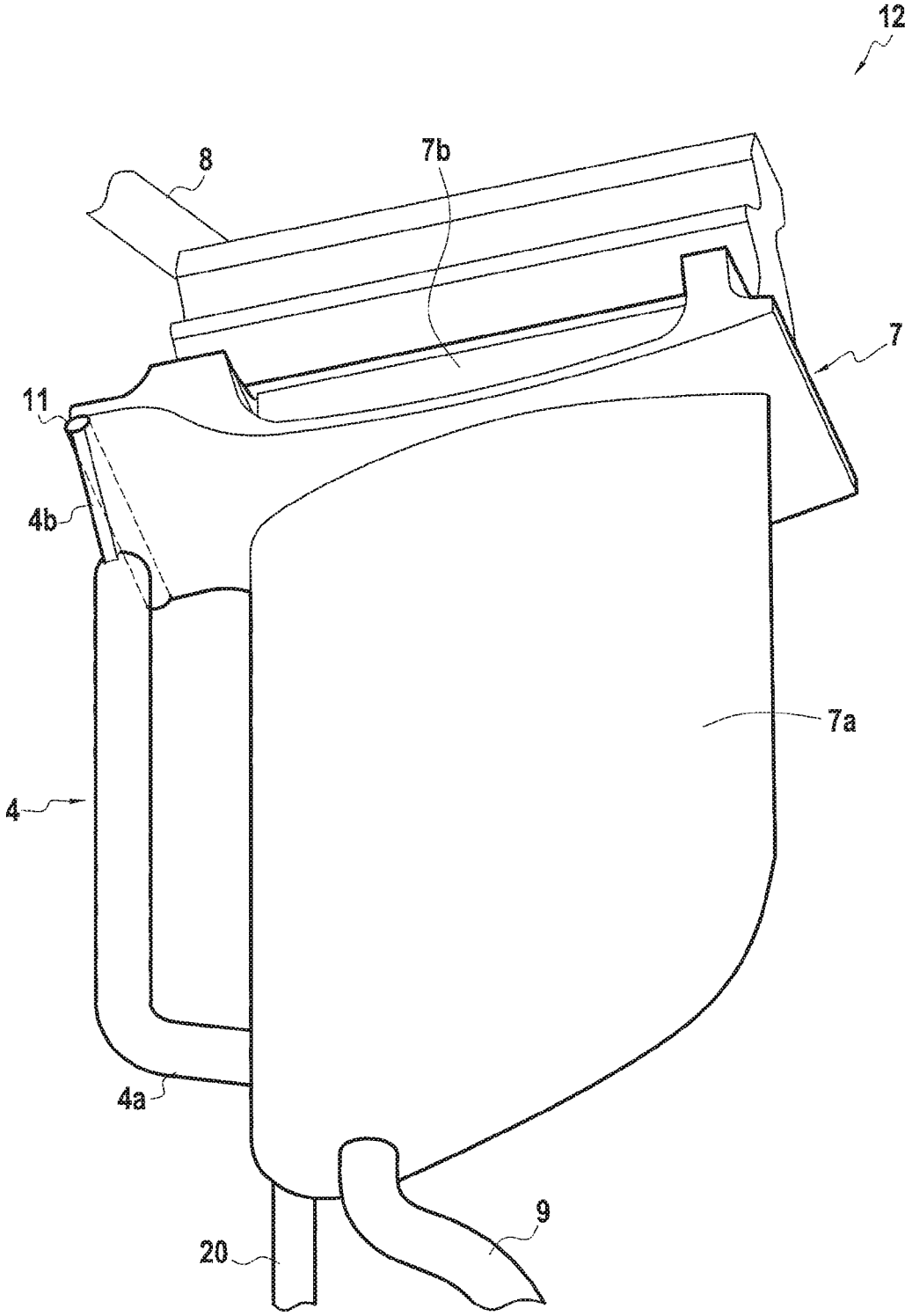
FIG. 2 is a diagrammatic perspective view of a model for producing the FIG. 1 mold.

The mold 1 may be produced by the so-called "lost-wax" or "lost-pattern" method. A first step in such a method is to create a model 12, such as that shown in FIG. 2. The model 12 is for forming the mold cavity 7 and also the starter cavity 10, the selector channel 9, the pouring bush 5, and the feed channel 8, which are all hollow in the mold 1. The model is obtained using a material having a low melting temperature, such as a suitable wax or resin. When it is intended to produce a large number of parts, it is possible in particular to produce these elements by injecting the wax or resin into a permanent mold. In order to support the model 12, a support rod 20 made of refractory material, e.g. of ceramic, is incorporated in the model 12, connecting its main body 7', corresponding to the mold cavity 7 to its base (not shown), corresponding to the starter cavity 10. In order to secure the support rod 20 to the model 12, it is possible to make use of the natural adhesion of the material of the model 12, or to make use of a suitable adhesive. The separator member 11 may also be incorporated in the same manner in the model 12, between the volume of the main body 7' corresponding to the top end 4*b* of the grain duct 4 and the volume corresponding to the horizontal projection adjacent to the second volume 7*b* of the mold cavity 7.

In this embodiment, in order to produce the mold 1 from the non-permanent model 12, the model 12 is dipped in a slip, and is then dusted with a refractory sand. These steps of dipping and dusting can be repeated several times over until a shell has been formed of slip-impregnated sand that presents a desired thickness around the model 12.

The model 12 coated in this shell can then be heated to melt and empty out the low-melting point material of the model 12 from the inside of the shell, while conserving the support rod 20 and the separator member 11. Thereafter, in a higher temperature baking step, the shell is sintered so as to consolidate the refractory sand in order to form the mold 1 in which the support rod 20 and the separator member 11 remain incorporated.

The metal or metal alloy used in this casting method is poured while molten into the mold 1 via the pouring bush 5 and it fills the starter cavity 10, the selector channel 9, and the mold cavity 7 via the feed channel 8. Among metal alloys that are suitable for use in this method, there are in particular monocrystalline nickel alloys such as, in particular: AM1 and AM3 from SNECMA; and also others such as CMSX-2®, CMSX-4®, CMSX-6®, and CMSX-10® from C-M Group; René® N5 and N6 from General Electric; RR2000 and SRR99 from Rolls Royce; and PWA 1480, 1484, and 1487 from Pratt & Whitney; among others. Table 1 shows the compositions of these alloys:

TABLE 1

Monocrystalline nickel alloy compositions in percentage by weight

| Alloy | Cr | Co | Mo | W | Al | Ti | Ta | Nb | Re | Hf | C | B | Ni |
|---|---|---|---|---|---|---|---|---|---|---|---|---|---|
| CMSX-2 | 8.0 | 5.0 | 0.6 | 8.0 | 5.6 | 1.0 | 6.0 | — | — | — | — | — | Bal |
| CMSX-4 | 6.5 | 9.6 | 0.6 | 6.4 | 5.6 | 1.0 | 6.5 | — | 3.0 | 0.1 | — | — | Bal |
| CMSX-6 | 10.0 | 5.0 | 3.0 | — | 4.8 | 4.7 | 6.0 | — | — | 0.1 | — | — | Bal |
| CMSX-10 | 2.0 | 3.0 | 0.4 | 5.0 | 5.7 | 0.2 | 8.0 | — | 6.0 | 0.03 | — | — | Bal |
| Rene N5 | 7.0 | 8.0 | 2.0 | 5.0 | 6.2 | — | 7.0 | — | 3.0 | 0.2 | — | — | Bal |
| Rene N6 | 4.2 | 12.5 | 1.4 | 6.0 | 5.75 | — | 7.2 | — | 5.4 | 0.15 | 0.05 | 0.004 | Bal |
| RR2000 | 10.0 | 15.0 | 3.0 | — | 5.5 | 4.0 | — | — | — | — | — | — | Bal |
| SRR99 | 8.0 | 5.0 | — | 10.0 | 5.5 | 2.2 | 12.0 | — | — | — | — | — | Bal |
| PWA1480 | 10.0 | 5.0 | — | 4.0 | 5.0 | 1.5 | 12.0 | — | — | — | 0.07 | — | Bal |
| PWA1484 | 5.0 | 10.0 | 2.0 | 6.0 | 5.6 | — | 9.0 | — | 3.0 | 0.1 | — | — | Bal |
| PWA1487 | 5.0 | 10.0 | 1.9 | 5.9 | 5.6 | — | 8.4 | — | 3.0 | 0.25 | — | — | Bal |
| AM1 | 7.0 | 8.0 | 2.0 | 5.0 | 5.0 | 1.8 | 8.0 | 1.0 | — | — | — | — | Bal |
| AM3 | 8.0 | 5.5 | 2.25 | 5.0 | 6.0 | 2.0 | 3.5 | — | — | — | — | — | Bal |

Figure 3:
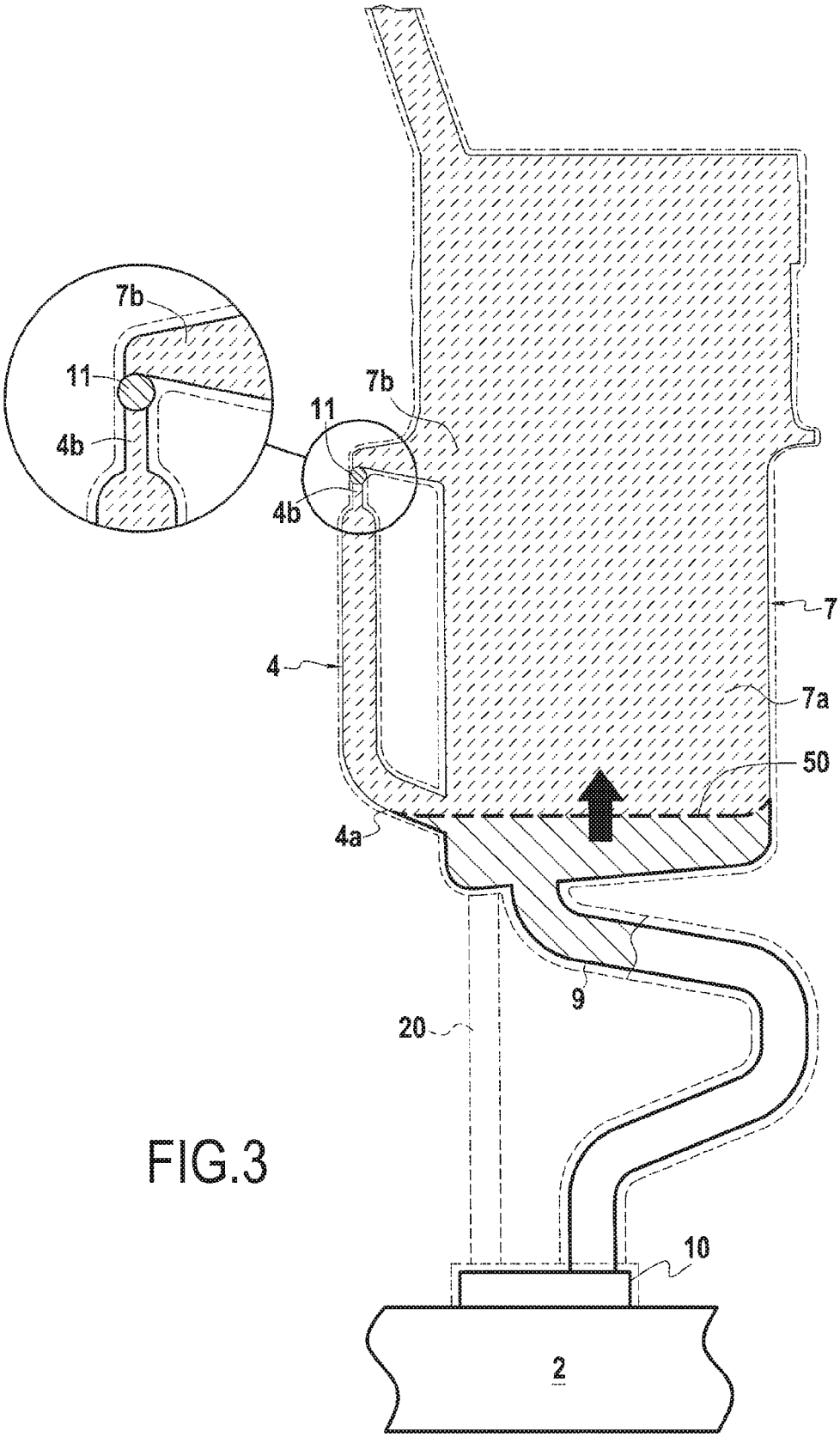
FIGS. 3, 4, and 5 are diagrams showing the progress of a cooling and solidification front in a casting method in the FIG. 1 installation.

While pouring, the mold 1 is maintained in a heater chamber 3 as shown in FIG. 1. Thereafter, in order to cause the molten metal to cool progressively, the mold 1 supported on a cooled and movable support 2 is extracted from the heater chamber 3 downwards along a main axis X. Since the mold 1 is cooled through its base 6 by the support 2, the molten metal begins solidifying in the starter cavity 10 and solidification propagates substantially vertically upwards in the mold 1 while it is being progressively extracted downwards from the heater chamber 3, with solidification following a front 50 as shown in FIG. 3. The choke formed by the selector channel 9, and also its baffle shape, nevertheless ensure that only one grain from among those initially seeded in the starter cavity 10 is able to continue to extend to the mold cavity 7.

Figure 4:
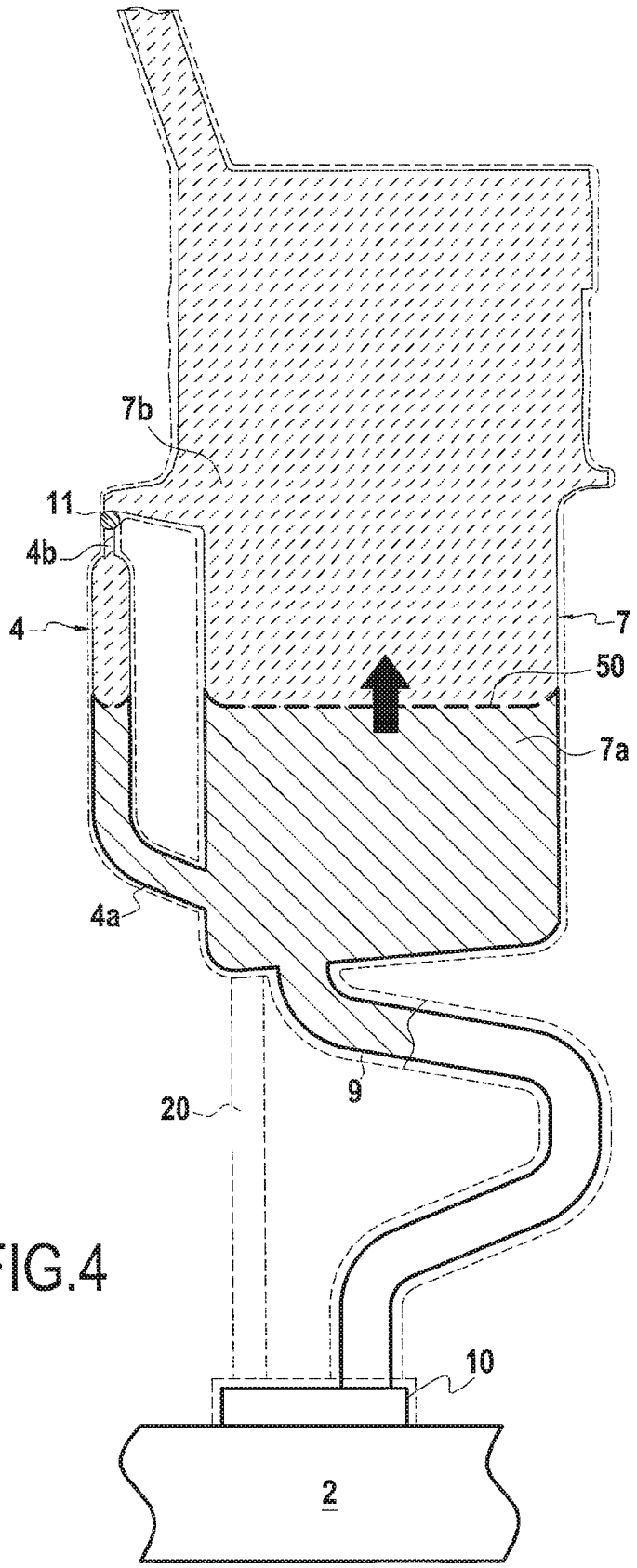
Figure 5:
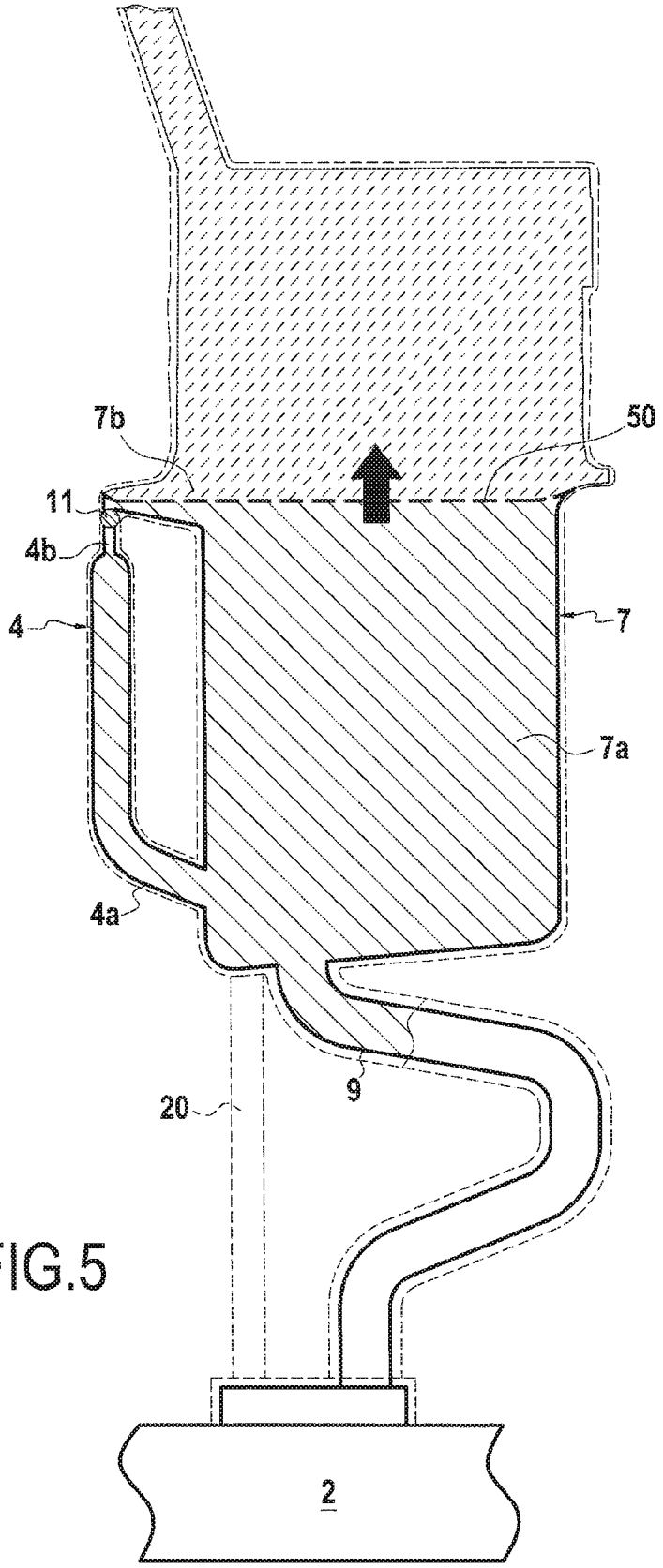

At the bottom end 4*a* of the grain duct 4, the cooling and solidification front 50 of the metal bifurcates, continuing to advance in the first volume 7*a* of the mold cavity 7 and also to advance in the grain duct 4, as shown in FIG. 4. Consequently, this cooling and solidification front 50 approaches substantially simultaneously the interface between the first and second volumes 7*a* and 7*b* of the mold cavity 7 and the top end 4*b* of the grain duct 4. Thus, because of the thermal conduction between the top end 4*b* of the grain duct 4 and the horizontal projection of the second volume of the mold cavity 7, the cooling and solidification front 50 can maintain in the second volume 7*b* a direction of advance that is substantially vertical, as shown in FIG. 5, as though the top end 4*b* of the grain duct 4 were actually in communication with the horizontal projection of the second volume of the mold cavity 7. This avoids any sudden change of direction in this advance in the second volume 7*b*, which might generate unwanted grains around the interface between the volumes 7*a* and 7*b* of the mold cavity 7.

After the metal has cooled and solidified in the mold 1, the mold can be knocked out in order to release the metal part, which can then be finished by machining and/or surface treatment methods. Both knocking out the mold and performing finishing treatment on the part are made very significantly easier by the separation between the top end 4*a* of the grain duct 4 and the second volume 7*b* of the mold cavity 7, since it suffices to break a single connection between the metal part and the metal branch corresponding to the grain duct in order to separate them.

Although the present invention is described with reference to a specific embodiment, it is clear that various modifications and changes may be undertaken thereon without going beyond the general ambit of the invention as defined by the claims. In addition, individual characteristics of the various embodiments mentioned may be combined in additional embodiments. Consequently, the description and the drawings should be considered in a sense that is illustrative rather than restrictive.

The invention claimed is:

1. A monocrystalline casting mold comprising:

a mold cavity comprising:

a first volume;

a second volume situated on the first volume, in communication therewith, and having at least one horizontal projection relative to the first volume; and a grain duct with a bottom end connected to the first volume and a top end adjacent to said horizontal projection of the second volume;

the mold further comprising a separator member interposed between said second volume of the mold cavity and the top end of the grain duct.

2. The mold according to claim 1, wherein the top end of the grain duct has a width that is substantially equal to said horizontal projection of the second volume.

3. The mold according to claim 1, wherein the first volume of the mold cavity corresponds to a turbomachine blade body and the second volume of the mold cavity corresponds to a turbomachine blade platform.

4. The mold according to claim 1, also presenting, under the mold cavity, a starter cavity connected to the mold cavity by a selector channel.

5. A method of fabricating the monocrystalline casting mold according to claim 1, the method comprising the following steps:

making a model reproducing at least the shape of the mold cavity;

coating said model in a refractory material so as to form at least the mold cavity; and emptying out at least the mold cavity wherein said separator member is inserted in said model before the coating step.

6. The method according to claim 5, wherein said model is made of a material that melts at a temperature lower than said refractory material and is emptied out from the mold cavity in the liquid state.

7. The method according to claim 5, wherein said coating step is performed by dipping the model in a slip, dusting the model with a refractory sand in order to form a shell around the model, and sintering the shell in order to consolidate it.

8. A method of using a mold for monocrystalline casting according to claim 1 the method comprising the following steps:

vacuum casting a metal material in the liquid state into the mold cavity;

causing the metal material to solidify in directional manner from the bottom of the mold cavity towards the top; and knocking out the mold, including the separator member interposed between the second volume of the mold cavity and the top end of the grain duct.

* * * * *